US006477800B1

(12) United States Patent
Payne

(10) Patent No.: US 6,477,800 B1
(45) Date of Patent: Nov. 12, 2002

(54) REFLECTIVE IMPACT-ABSORBING BUMPERS FOR UTILITY POLES

(76) Inventor: Stephanie Olivia Payne, 4448 Lost Pine Dr., Tallahassee, FL (US) 12720

( * ) Notice: Subject to any disclaimer, the term of this patent is extended or adjusted under 35 U.S.C. 154(b) by 0 days.

(21) Appl. No.: 09/711,235

(22) Filed: Nov. 13, 2000

(51) Int. Cl.[7] ..... G09F 13/16; G09F 15/00
(52) U.S. Cl. ..... 40/582; 40/607; 40/612
(58) Field of Search ..... 40/582, 607, 611, 40/612, 650, 660, 666; D20/41

(56) References Cited

U.S. PATENT DOCUMENTS 2,539,546 A * 1/1951 McGuire ..... 40/607
2,616,196 A * 11/1952 Sandahl, Jr. et al. ..... 40/607
3,986,284 A * 10/1976 Plantinga ..... 40/607
4,164,084 A * 8/1979 Crockett ..... 40/607 X
4,297,050 A * 10/1981 Gmelch ..... 40/608 X
4,300,299 A * 11/1981 Batky et al. ..... 40/607
4,454,671 A * 6/1984 Morganstern ..... 40/607
5,116,204 A * 5/1992 Power et al. ..... 40/607
5,675,923 A * 10/1997 Sarkisian et al. ..... 40/611 X
6,148,555 A * 11/2000 Beauchamp et al. ..... 40/611 X
6,269,570 B1 * 8/2001 Miles ..... 40/607

* cited by examiner

*Primary Examiner*—Brian K. Green
(74) *Attorney, Agent, or Firm*—Michael I Kroll

(57) ABSTRACT

A device is provided for attachment to utility poles, trees, and the like, which positions one or more light reflective panels within channels in a bifurcated, double halo shaped housing. The housing swings open into two sections for changing the panels. The housing is mounted on the pole by first attaching two X-braces to the pole and then fastening the housing to the braces with screws. The housing is constructed of resilient materials, such as rubber, which provide energy absorption in the event a car impacts the device and pole. Panels can contain general messages, traffic warnings and any number of signals or designs. Locking plates are provided for locking the device about the pole are provided. When properly positioned on a pole the panel or panels circumvent all or part of the pole and are highly visible when the headlights of oncoming vehicles strike the panels.

23 Claims, 8 Drawing Sheets

REFLECTIVE IMPACT-ABSORBING BUMPERS FOR UTILITY POLES

BACKGROUND OF THE INVENTION

1. Field of the Invention

The present invention relates generally to road safety devices and, more specifically, to a bifurcated, double-halo, rubber housing that is secured around the circumference of a utility pole at a height sufficient to receive the impact of an average size motor vehicle, thereby reducing the stress delivered to the utility pole in the event a collision. Highly reflective panels extend peripherally within the housing to increase the pole's visibility during hazardous conditions such as rain, snowstorms and heavy fog, thereby reducing the possibility of a collision. This is particularly true when the present invention is used on a series of poles in a poorly lit area thereby effectively illuminating the curvature of a road. Road warning messages are printed on the reflective panels as are public service messages, holiday greetings, aesthetic designs, logos, etc.

The reflective panels are removable and can be accessed even when the present invention is installed, thereby enabling a user to change messages or designs as desired.

The present invention will provide a low-cost aesthetic means for reflectively increasing the visibility of utility poles while simultaneously providing messages to increase awareness of upcoming hazardous road conditions thereby reducing the possibility of a vehicle colliding with the pole. Furthermore, in the event that such a collision occurs, shock dispersion is provided to reduce damage to both the utility pole and to the vehicle, being particularly effective during low-impact conditions.

2. Description of the Prior Art

There are numerous road safety devices. While these road safety devices may be suitable for the purposes for which they were designed, they would not be as suitable for the purposes of the present invention as heretofore described. It is thus desirable to provide a bifurcated, double-halo, rubber housing that is secured around the circumference of a utility pole, that is installed at an appropriate height to accept and disperse impact from a motor vehicle, and that has highly-reflective panels extending peripherally nearly 360 degrees within the housing assembly, thereby increasing the visibility of the pole and reducing the risk of such a collision.

The present invention will decrease the amount of vehicular accidents with utility poles and the severity of the accidents that do occur, thereby saving lives, reducing accident related injuries and the cost of property damage to both the vehicle and particularly to the utility pole wherein a collision could necessitate the costly replacement of a damaged pole, or result in a power outage to a community due to downed power lines.

SUMMARY OF THE PRESENT INVENTION

The present invention relates generally to road safety devices and, more specifically, to a bifurcated, double-halo, rubber housing that is secured around the circumference of a utility pole by means of two X-braces fastened to opposing sides of said utility pole. The bifurcated double-halo housing assembly is manufactured of a resilient material and comprises two semi-circumferential housing sections with each said section having a semi-circular upper housing member and a symmetrical lower housing member. The members are of a substantial thickness with the ends of each said upper housing member connected to it's corresponding lower housing member by means of an integral vertical member extending peripherally from each end.

The two semi-circumferential housing sections are pivotably connected at the vertical members on one end and have matching recesses to accept a locking mechanism on the vertical members of the other end, so that when swung together into the closed position they create the double halo effect of two circular, substantially horizontal, parallel members with each member having a central recess being of sufficient size to encompass a utility pole.

Each housing section includes a removable, highly reflective, resilient fiberglass panel which can also contain road warning signs, indicia, logos, public service messages, etc. and is to be inserted into and maintained by retaining recesses integrated within the lower region of the upper housing members and the corresponding upper region of the lower housing members.

A primary object of the present invention is to provide a resilient, impact-absorbing bumper that encompasses a utility pole at a height sufficient to receive and absorb the impact of a motor vehicle thereby minimizing damage to the utility pole in the event of a collision.

Another object of the present invention is to provide a resilient impact-resistant bumper for utility poles having a bifurcated housing assembly manufactured of a resilient material, such as rubber, comprising two semi-circular housing sections pivotably connected on one end in a manner allowing the second section to be fastened to the utility pole at a selectable height by means of an X-brace and then the first section can than be swung closed and secured to form a circular housing having a central recess of a diameter greater than that of the utility pole thereby surrounding the circumference of said utility pole to afford 360 degree protection.

Yet another object of the present invention is to provide a bifurcated, impact-resistant bumper for utility poles having a double halo housing assembly wherein each housing section has a resilient upper and lower housing member of a substantial thickness connected to one another by vertical members on their respective ends thus forming two enjoined parallel members that are spaced apart.

Still another object of the present invention is to provide an impact-resistant bumper for utility poles wherein each section of said housing assembly includes a replaceable, resilient, reflective panel to provide a 360 degree increase in visibility during low light and hazardous weather conditions.

A still further object of the present invention is to provide a reflective, impact-resistant bumper for utility poles wherein said reflective panels may contain indicia such as road information, pictures, designs, et cetera.

A yet further object of the present invention is to provide a reflective, impact-resistant bumper for utility poles wherein said reflective panels can be easily accessed and replaced from within an installed unit by removing the four securing screws maintaining a housing section to it's respective X-brace on the pole and swinging it open.

Another object of the present invention is to provide a reflective, impact-resistant bumper for utility poles having a locking means to prevent unauthorized access to or removal of the present invention.

A device is provided for displaying a light reflective panel about a pole and the like, the panel having a top edge and a bottom edge, comprising: a housing, the housing having a first and second section, each section having a top housing member and a bottom housing member, each housing member having an inner edge, each inner edge being generally semicircular, the housing first and second sections further being pivotably connected and closable to form a generally circular aperture, the top and bottom housing members being sized such that the aperture circumvents the pole, and further, the housing first section and second section each having a downwardly facing and upwardly facing channel, the downwardly facing channels being sized to closely receive the panel top edge, the upwardly facing channels being sized to closely receive the panel bottom edge; and a mounting bracket for attaching the housing to the utility pole.

A device is provided for attachment to poles and the like, comprising: a light reflective, elongated panel, the panel having a top edge and a bottom edge; a housing, the housing having a first and second section, each section having a top housing member and a bottom housing member, each housing member having an inner edge, each inner edge being generally semicircular, the housing first and second sections further being pivotably connected and closable to form a generally circular aperture, the top and bottom housing members being sized such that the aperture circumvents the pole, and further, the housing first section and second section each having a downwardly facing and upwardly facing channel, the downwardly facing channels being sized to closely receive the panel top edge, the upwardly facing channels being sized to closely receive the panel bottom edge; and a mounting bracket for attaching the housing to the utility pole.

In another embodiment of the foregoing device, the housing first section has a first end, the first section first end having a hole, and the housing second section has a first end, the second section first end having a hole, such holes being substantially aligned and adjacent upon closure of the housing first and second sections.

In another embodiment of the foregoing device, the device comprises a lock, the lock being attachable through the housing first section first end hole and the housing second section first end hole.

In another embodiment of the above described device, and upon closure about the pole, the housing first section upwardly facing channel aligns with the housing second section upwardly facing channel, and further the housing first section downwardly facing channel aligns with the housing second section downwardly facing channel, such that the panel is positionable within the housing first and second sections simultaneously.

In another embodiment of the above-described device, the first and second housing sections are resilient.

In another embodiment of the above-described device, the first and second housing sections are made of at least some resilient materials.

In another embodiment of the above-described device, the housing first and second sections each have an outer edge, housing first section outer edge being generally parallel to the housing first section top and bottom member inner edges, the housing second section outer edge being generally parallel to the housing second section top and bottom member inner edges.

In another embodiment of the above-described device, the number of panels is two or more.

In another embodiment of the above-described device: the mounting bracket further comprises a pair of braces, each brace having an upper pair of threaded holes and a lower pair of threaded holes, each brace further having a fifth hole, the mounting bracket further comprising an elongated fastener for threading through the pole and through each of the brace fifth holes, for attaching the two braces with the pole between such braces; the housing first section top member has a pair of holes and the housing second section top member has a pair of holes, the housing first and second section top member hole pairs aligning with the upper hole pairs on the two braces; the housing first section bottom member has a pair of holes and the housing second section bottom member has a pair of holes, the housing first and second section bottom members' hole pairs aligning with the upper hole pairs on the two braces; and the device further comprises threaded fasteners for joining the housing first and second sections to the braces, by inserting the fasteners into the aligned hole pairs.

In another embodiment of the foregoing device, the threaded fasteners are screws.

In another embodiment of the above-described device, the threaded fasteners are bolts.

In another embodiment of the foregoing device, one of the upper threaded holes and one of the lower threaded holes on each brace are aligned with one of the top member holes and one of the bottom member holes, respectively, in the first section, and one of the upper threaded holes and one of the lower threaded holes on each brace are aligned with one of the top member holes and one of the bottom member holes, respectively, in the second section.

In another embodiment of the above-described device, the braces are X-shaped.

In another embodiment of the above-described device, the housing first and second sections each have at least one hole, and further the mounting bracket further comprises at least two fasteners and at least one brace, the at least one brace being mounted to the pole, the at least one brace having a total of at least two holes, such at least two holes being alignable with the first and second housing sections' at least one hole, the alignments allowing fastening with the fasteners.

In another embodiment of the foregoing device, at least one brace extends between the housing top and bottom sections.

In another embodiment of the above-described device, the number of braces is two.

In another embodiment of the foregoing device, the housing first and second sections each have a plurality of holes and the two braces each have a plurality of holes aligned with such first and second sections' plurality of holes, the alignments allowing fastening using the fasteners.

In another embodiment of the above-described device, the housing first and second sections each have a plurality of holes, the first brace has a plurality of holes aligned with at least one of the first section's holes and at least one of the second sections' holes, and the second brace has a plurality of holes aligned with at least one of the first section's holes and at least one of the second section's holes, the alignments allowing fastening using the fasteners.

In another embodiment of the above-described device, each brace has four holes, the housing first section has four holes and the housing second section has four holes, and further two of the first brace holes align with two of the housing first section holes, two of the first brace holes align with two of the housing second section holes, two of the second brace holes align with two of the housing first section holes, and two of the second brace holes align with two of the housing second section holes, the alignments allowing fastening using the fasteners.

A device is provided for attachment to poles and the like, comprising means for positioning a light reflective, elongated panel about the pole.

Another embodiment of the foregoing device, further comprises means for absorbing energy when the apparatus is struck by a moving object.

In another embodiment of the above-described device, the device further comprises means for locking the apparatus to the pole.

In another embodiment of the above-described device, the panel is circumferentially positioned about the pole.

A device is provided for attachment to poles and the like, comprising: a light reflective, elongated panel, the panel having a top edge and a bottom edge; a housing, the housing having a first and second section, each section having a top housing member and a bottom housing member, each housing member having an inner edge, each inner edge being generally semicircular, the housing first and second sections further being pivotably connected and closable to form a generally circular aperture, the top and bottom housing members being sized such that the aperture circumvents the pole, and further, the housing first section and second section each having a downwardly facing and upwardly facing channel, the downwardly facing channels being sized to closely receive the panel top edge, the upwardly facing channels being sized to closely receive the panel bottom edge; and means for attaching the housing to the utility pole.

A device is provided for attachment to poles and the like, comprising: a light reflective, elongated panel, the panel having a top edge and a bottom edge; a housing, the housing having a first and second section, each section having a top housing member and a bottom housing member, each housing member being resilient and having an inner edge, each inner edge being generally semicircular, and an outer edge, the outer edge being generally parallel to the inner edge, the housing first and second sections further being pivotably connected and closable to form a generally circular aperture, the top and bottom housing members being sized such that the aperture circumvents the pole, and further, the housing first section and second section each having a downwardly facing and upwardly facing channel, the downwardly facing channels being sized to closely receive the panel top edge, the upwardly facing channels being sized to closely receive the panel bottom edge, the first and second section downwardly facing channels being aligned, and the upwardly facing channels being aligned, such that the panel is positionable within the housing first and second sections simultaneously; and a mounting bracket for attaching the housing to the utility pole.

In another embodiment of the foregoing device: the mounting bracket further comprises a pair of braces, each brace having an upper pair of threaded holes and a lower pair of threaded holes, each brace further having a bolthole, the mounting bracket further comprising a bolt for threading through the pole and through the each of the brace boltholes, for attaching the two braces; the housing first section top member has a pair of holes and the housing second section top member has a pair of holes, the housing top and bottom member hole pairs aligning with the upper hole pairs on the two braces; the housing first section bottom member has a pair of holes and the housing second section bottom member has a pair of holes, the housing first and second section bottom members'hole pairs aligning with the upper hole pairs on the two braces; and the device further comprises threaded fasteners for joining the housing first and second sections to the braces, by inserting the fasteners into the aligned hole pairs.

Additional objects of the present invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

DESCRIPTION OF THE REFERENCED NUMERALS

Figure 1:
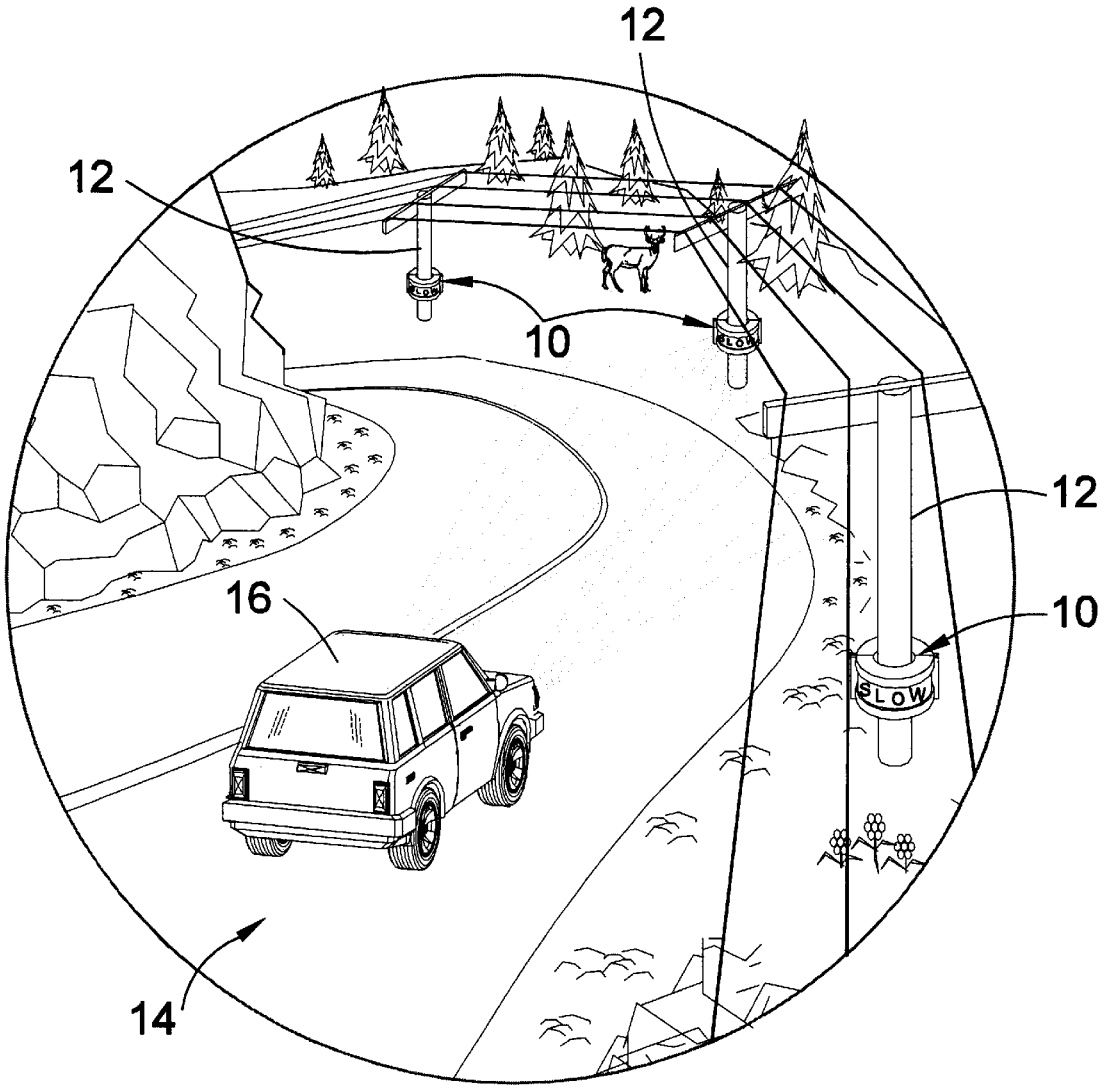
FIG. 1 is perspective view of the present invention in use on a series of utility poles.

Turning now descriptively to the drawings, in which similar reference characters denote similar elements throughout the several views, the figures illustrate reflective impact-absorbing bumpers for utility poles of the present invention. With regard to the reference numerals used, the following numbering is used throughout the various drawing figures.

10 reflective impact-absorbing bumpers for utility poles of the present invention
12 utility pole
14 highway
16 vehicle
20 first section
22 second section
24 hinge
26 first section top member
28 second section top member
30 first section top member inner edge
32 second section top member inner edge
34 first section top member outer edge
36 second section top member outer edge
38 first section bottom member

40 second section bottom member
42 first section bottom member inner edge
44 second section bottom member inner edge
46 first section bottom member outer edge
48 first section bottom member outer edge
50 panel
52 panel message
54 panel message
56 panel traffic warning
58 panel top edge
60 first section top member downwardly facing channel
62 second section top member downwardly facing channel
64 panel bottom edge
66 first section bottom member upwardly facing channel
68 second section bottom member upwardly facing channel
70 first X-brace
72 second X-brace
74 bolt hole in first X-brace
76 bolt hole in second X-brace
78 utility pole hole
80 bolt
82 first section top member hole
84 first section top member hole
86 second section top member hole
88 second section top member hole
92 threaded hole on second brace
94 threaded hole on first brace
96 threaded hole on second brace
98 threaded hole on second brace
100 first section bottom member hole
104 second section bottom member hole
110 threaded hole on second brace
112 threaded hole on first brace
114 threaded hole on second brace
116 threaded hole on second brace
118 threaded fasteners
120 first locking plate
122 second locking plate
124 first locking plate hole
126 second locking plate hole
128 padlock

DETAILED DESCRIPTION OF THE PREFERRED EMBODIMENT

Turning now descriptively to the drawings, in which similar reference characters denote similar elements throughout the several views, FIGS. 1–8 illustrate the reflective impact-absorbing bumpers for utility poles of the present invention indicated generally by the numeral 10.

Figure 5:
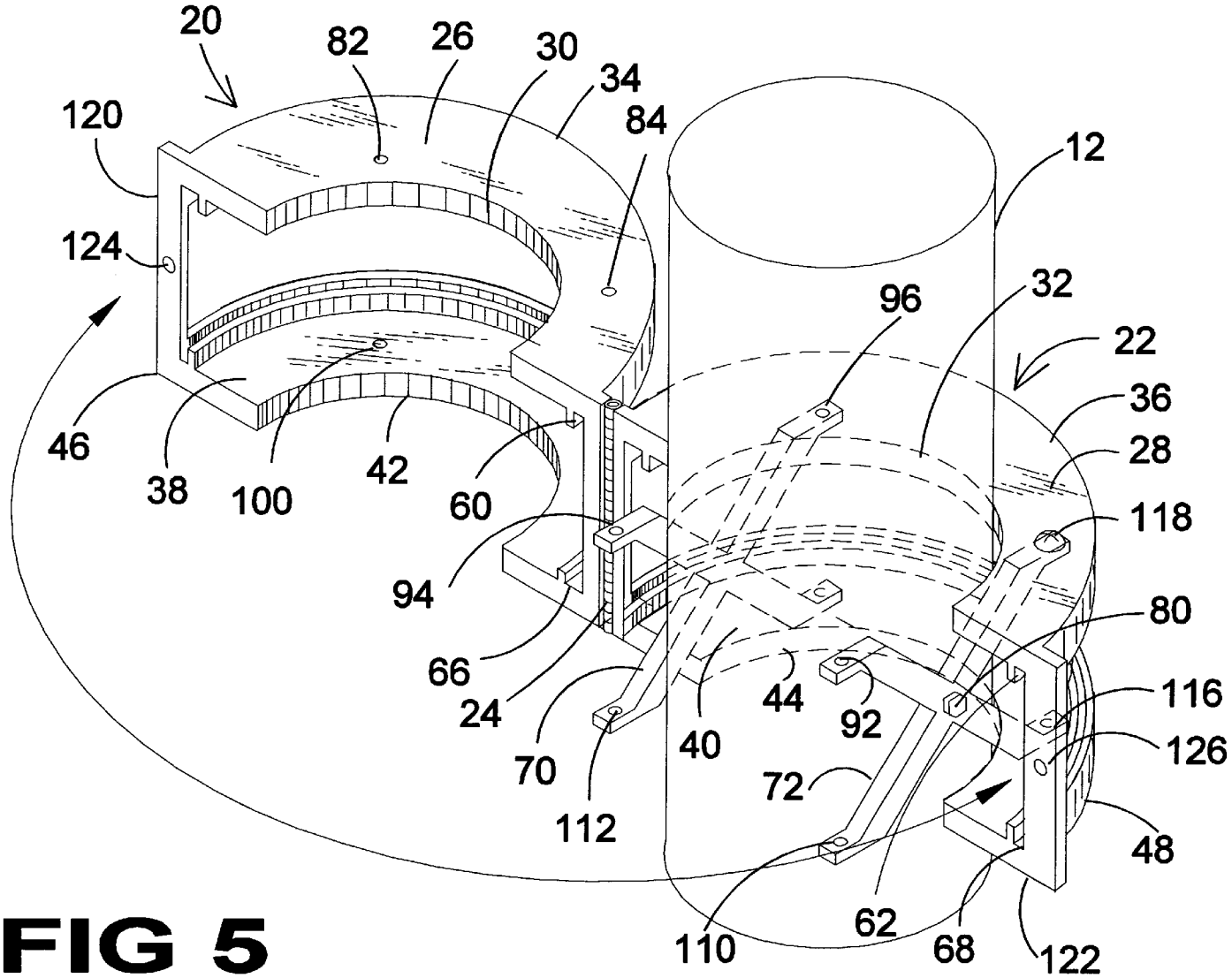
FIG. 5 is a perspective view showing one section of the housing assembly affixed to the X-braces.
Figure 6:
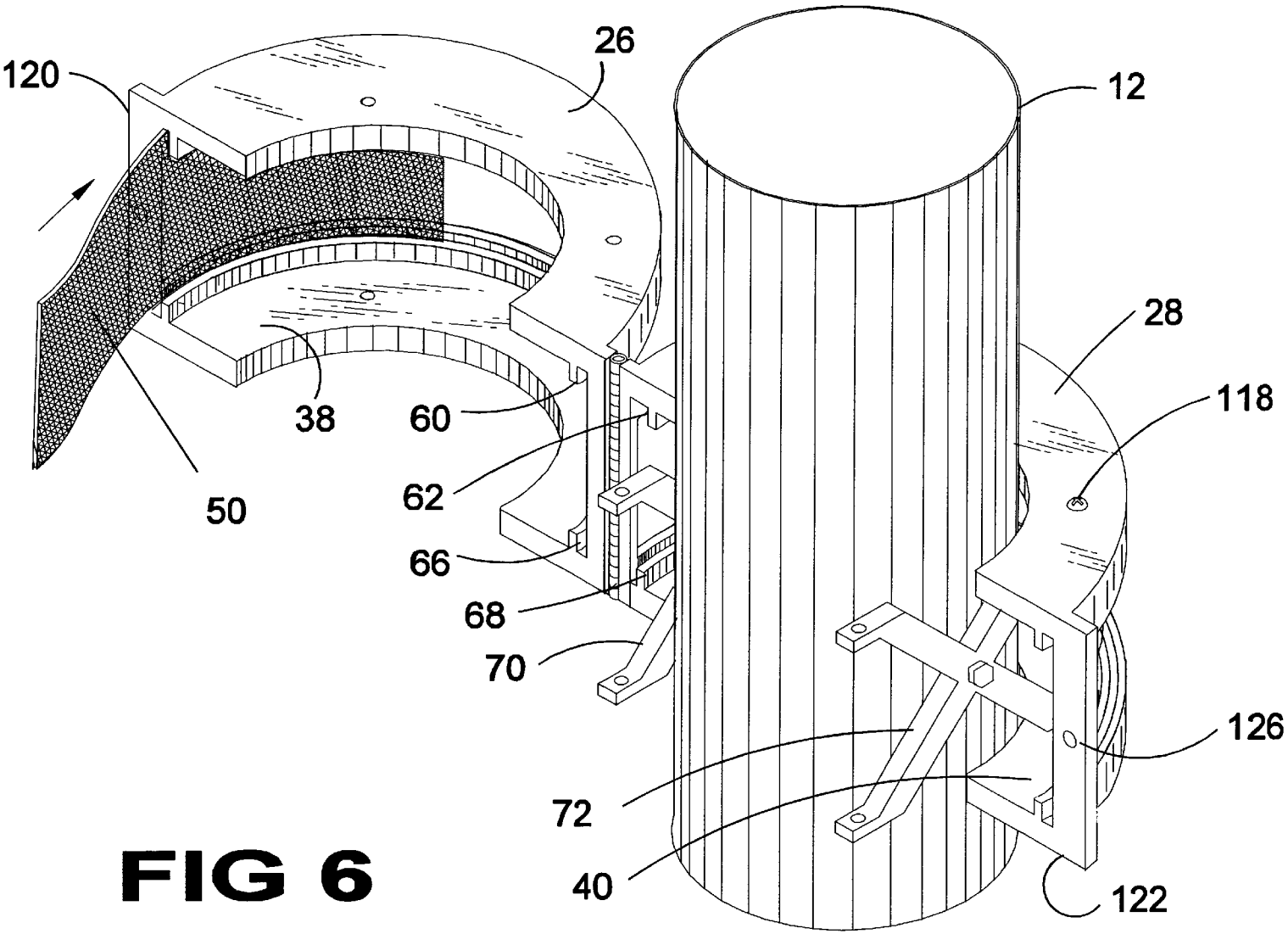
FIG. 6 is a perspective view of the present invention with one section of the housing assembly fastened to the X-braces and a reflective panel being inserted into the retaining recesses of the free-swinging section of the housing assembly.
Figure 7:
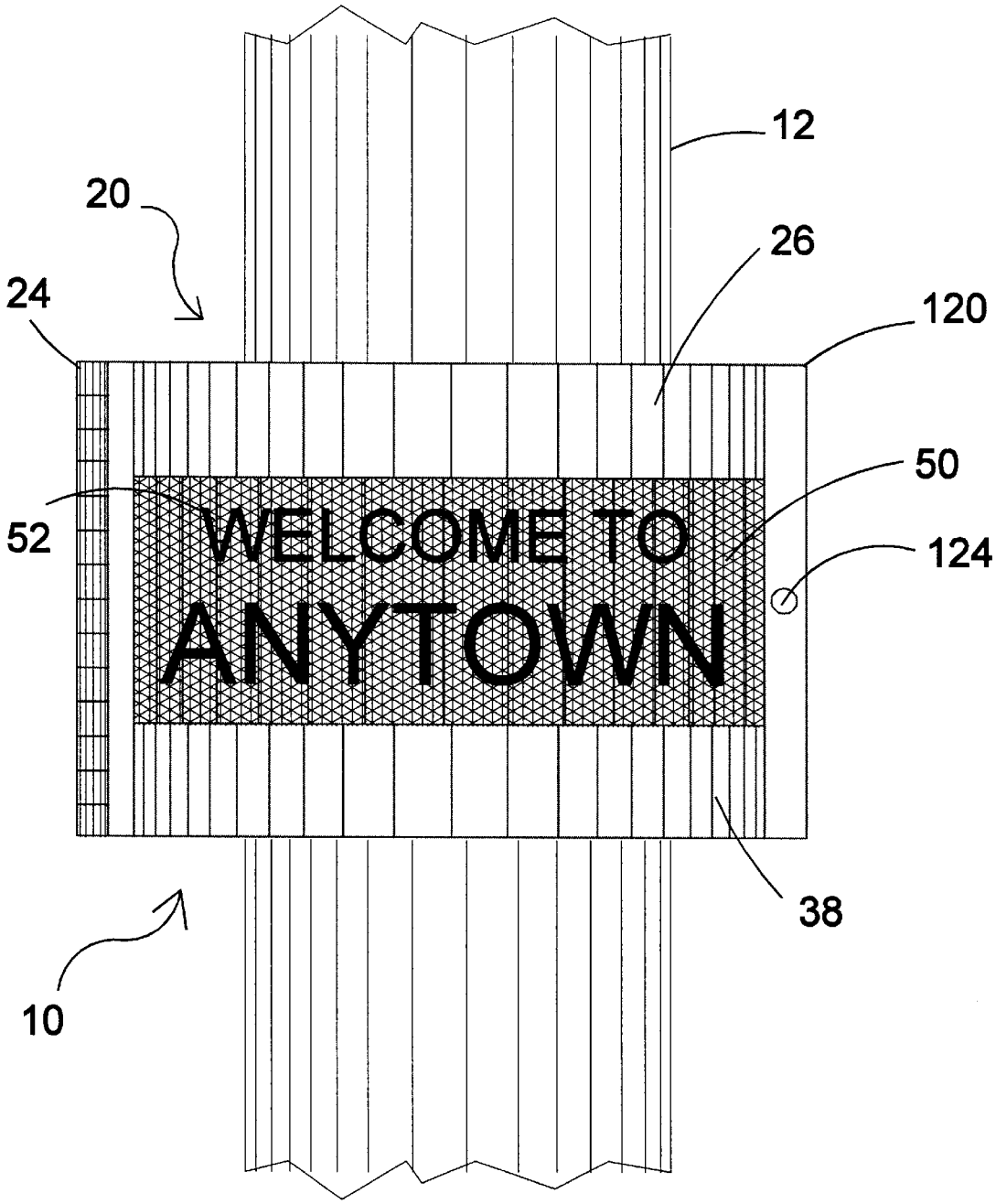
FIG. 7 is a side view of the present invention in use showing indicia on the reflective panel.
Figure 8:
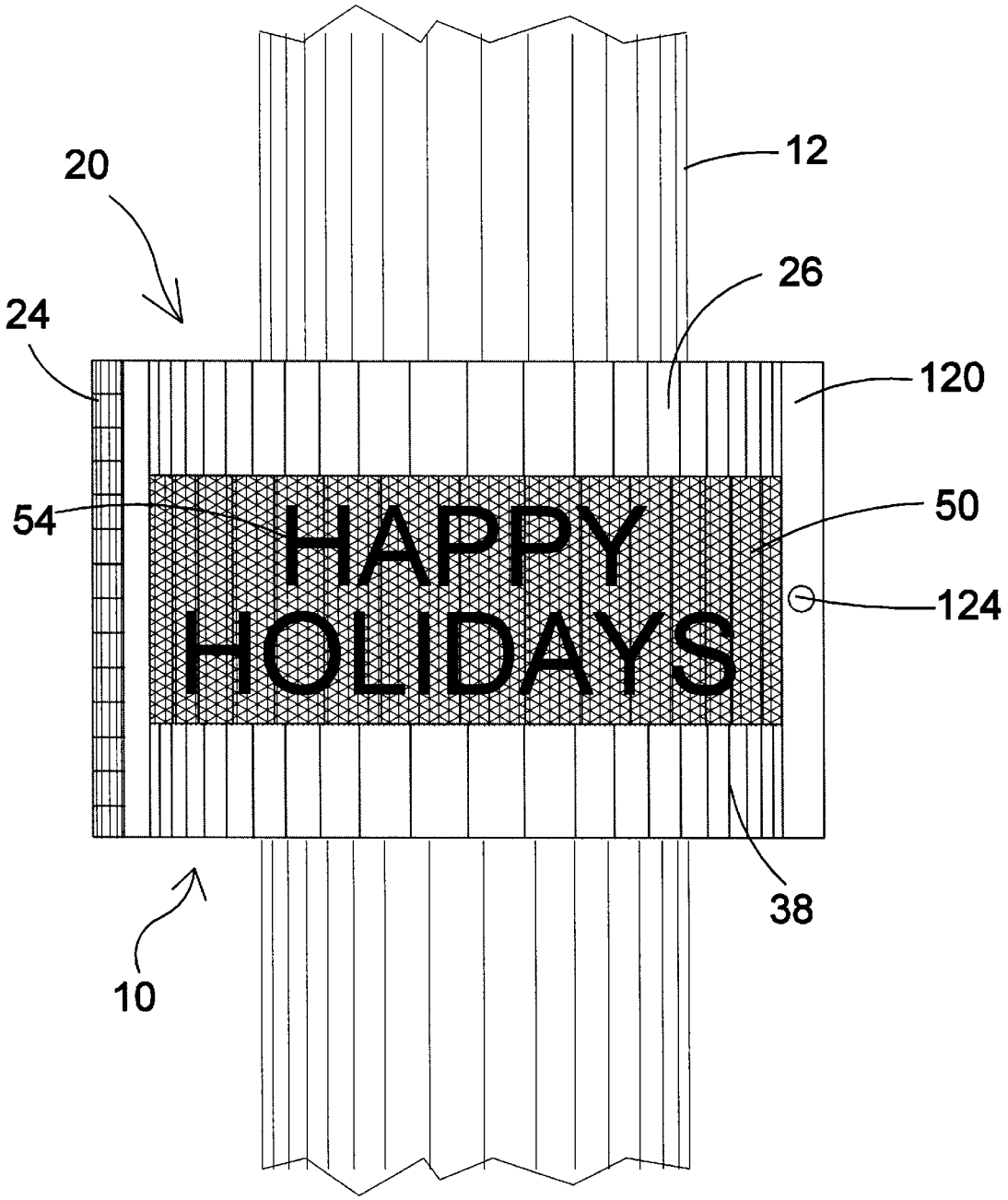
FIG. 8 is a side view of the present invention in use showing indicia on the reflective panel representing a different type of message that can be inserted at an appropriate time.

The device 10 is shown generally in FIGS. 1–8, and in use in FIGS. 1, 7 and 8 affixed to a utility pole 12 on a highway 14, as the oncoming vehicle's 16 lights fall on the device 10.

Figure 2:
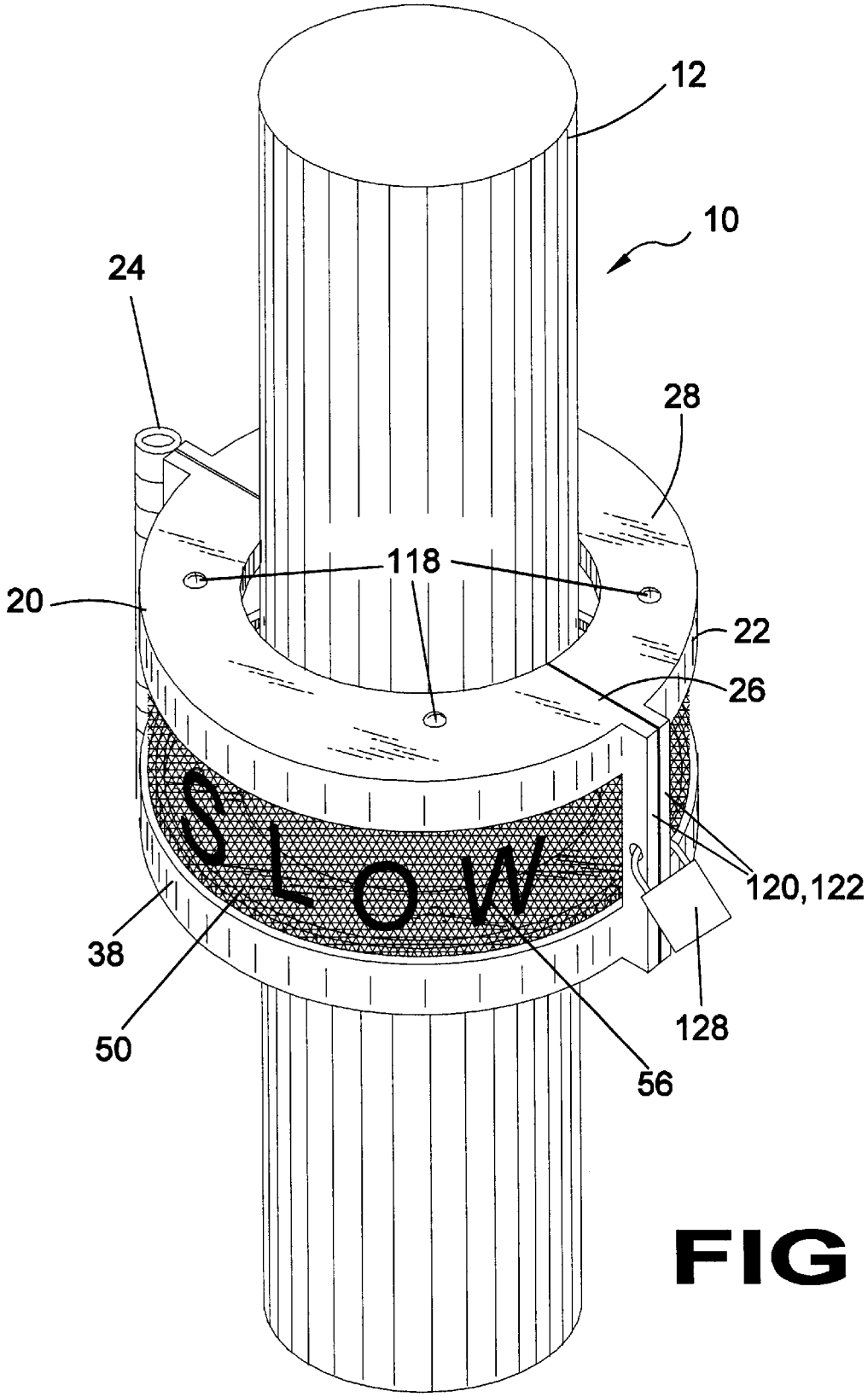
FIG. 2 is a detailed perspective view of the present invent ion installed on a utility pole.
Figure 3:
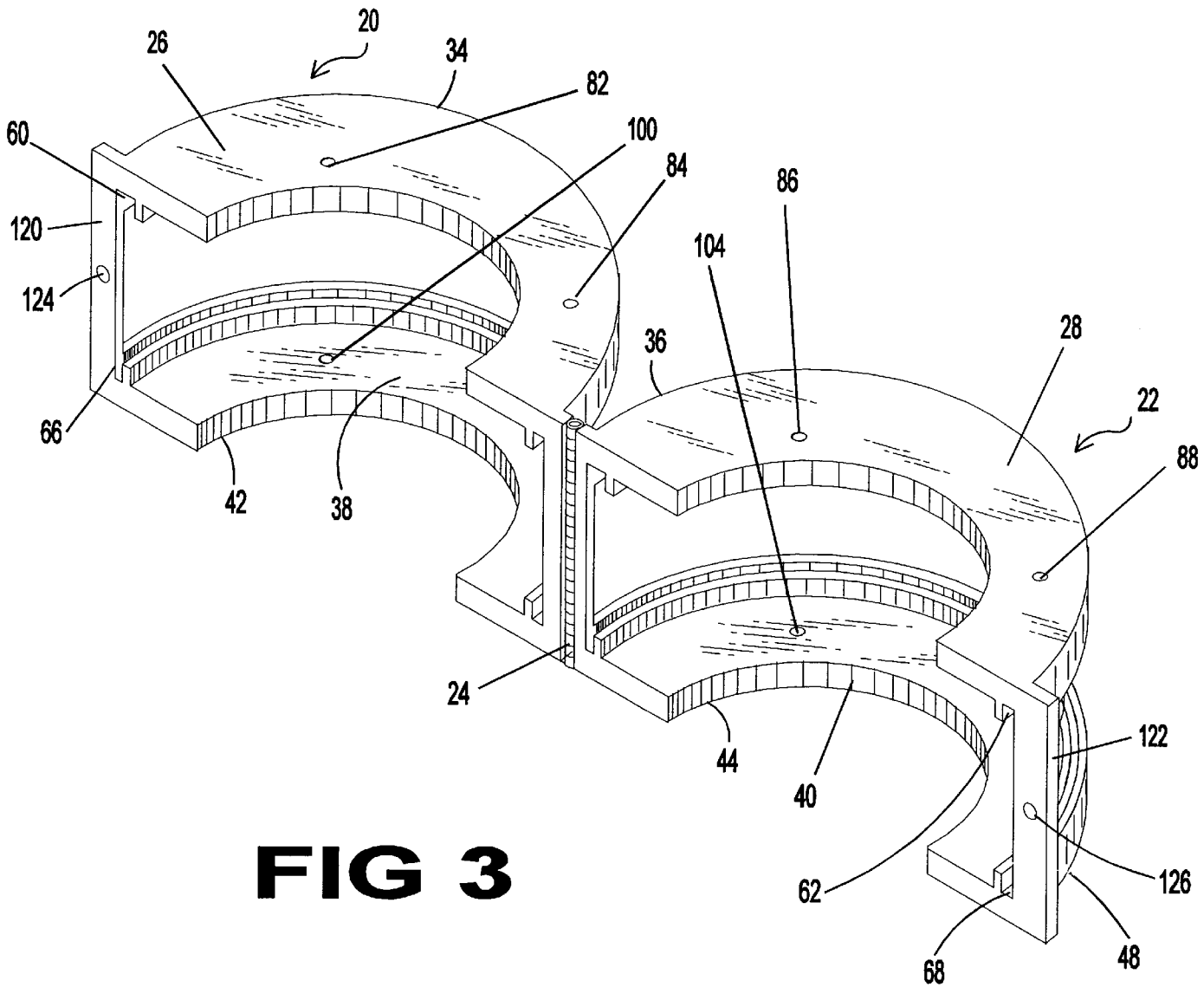
FIG. 3 is a perspective view of the housing assembly of the present invention opened up and without the reflective panels in place.

The device 10 includes a bifurcated first section 20 and second section 22, the sections 20,22 being joined by a hinge 24, such that the sections 20,22 are closable and generally double halo-shaped, as shown in FIG. 2 and FIG. 3.

As shown in FIG. 3, both sections 20,22 have a top member 26,28 that is semicircular in shape and generally planar. The top members 26,28 have semicircular inner edges 30,32 and outer edges 34,36, such that, when the first and second sections 20,22 are closed, the inner edges 30,32 form a generally circular aperture that circumvents the utility pole 12, as shown in FIG. 2. The device 10 can also be utilized on trees, fence posts, etc.

Similarly, the first and second sections 20,22 have bottom members 38,40 that are semicircular in shape and generally planar. The bottom members 38,40 have semicircular inner edges 42,44 and outer edges 46,48, such that, when the first and second sections 20,22 are closed, the inner edges 42,44 form a generally circular aperture that also circumvents the utility pole 12.

The first and second sections'20,22 top members 26,28 and bottom members 38,40 are constructed from resilient materials, such as rubber, plastic and the like, although other resilient materials can also be used, all in accordance with the present invention, and as determined by the intended end use for the overall device 10, as will occur to those of skill in the art upon review of the present disclosure.

An elongated, reflective, and flexible panel 50 is provided. As shown in FIGS. 1–2 and 7–8, the panel 50 can include any number of messages 52,54, traffic symbols, traffic warnings 56, artwork or designs. As shown in FIG. 3, the panel 50 has a top edge 58 that is closely received by downwardly facing channels 60,62 on the first section top member 26 and the second section top member 28, the channels 60,62 being proximate the first section top member outer edge 34 and the second section top member outer edge 36.

Similarly, the panel 50 has a bottom edge 64 that is closely received by upwardly facing channels 66,68 on the first section bottom member 38 and the second section top member 40, the channels 66,68 being proximate the first section bottom member outer edge 46 and the second section top member outer edge 48.

The downwardly facing channels 60,62 are aligned when the first and second sections 20,22 are closed, and the upwardly facing channels 66,68 are also aligned upon such closure, such that a single panel can be simultaneously positioned within both the first and second sections 20,22.

The panel 50 can vary in length, and two or more panels 50 can be simultaneously displayed. Furthermore, the channels 62,64,66,68 can extend completely or partially about the first and second sections 20,22. The panels 50 can be constructed from fiberglass, plastic or other well known materials having appropriate flexibility and durability, all in accordance with the present invention, and as determined by the intended end use for the overall device 10, as will occur to those of skill in the art upon review of the present disclosure.

Figure 4:
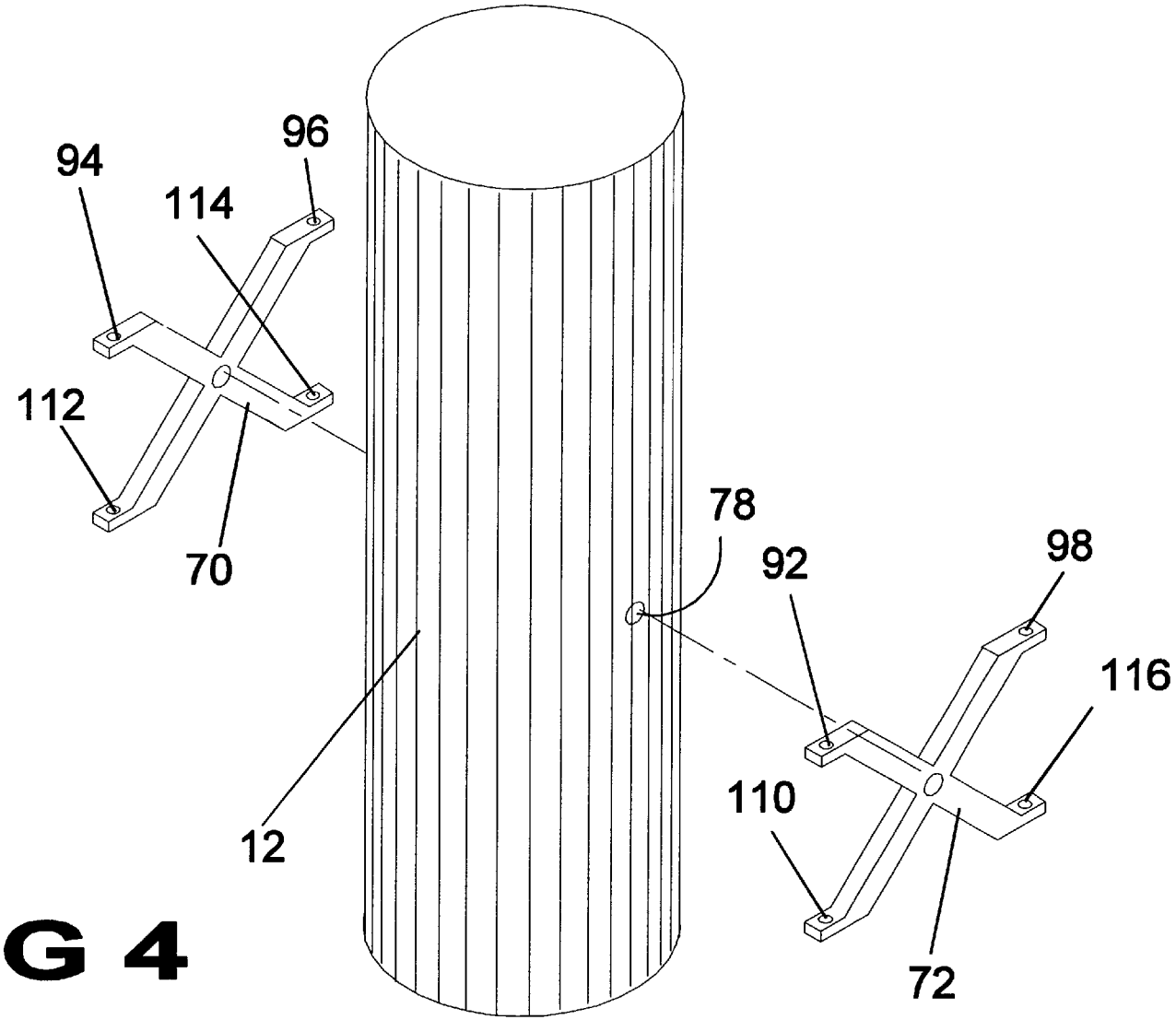
FIG. 4 is an exploded view illustrating the placement of the X-braces to the utility pole for installation of the present invention.

As shown in FIGS. 4–6, two X-shaped braces 70,72 are provided that have centrally located holes 74,76 that align with a pre-drilled hole 78 in the utility pole 12. A bolt 80 is inserted through the hole 76 in brace 72, through the utility pole hole 78, and then through the hole 74 in brace 70, where it is fastened using a nut or other conventional fasteners.

As shown in FIG. 5, the first section top member 26 has two holes 82,84 that align with a threaded hole 92 on brace 72 and a threaded hole 94 on brace 70, respectively. The second section top member 28 has two holes 86,88 that align with a threaded hole 96 on brace 72 and a threaded hole 98 on brace 70, respectively. The first section bottom member 38 has two holes 100 (one hidden) that align with a threaded hole 110 on brace 72 and a threaded hole 112 on brace 70, respectively. The second section bottom member 40 has two holes 104 (one hidden) that align with a threaded hole 114 on brace 72 and a threaded hole 114 on brace 70, respectively. Threaded fasteners 118, such as screws and the like, are used to complete the attachment of the first and second section top and bottom members 26,28,38,40 to the braces 70,72. Other fasteners, such as bolts, can be used, as well as, having male fastener members extend from the braces 70,72, and braces of varying shapes and numbers of threaded holes, all in accordance with the present invention, and as determined by the intended end use for the overall device 10, as will occur to those of skill in the art upon review of the present disclosure.

To protect against theft, a first locking plate 120 is attached to the first section 20, joining the first section top member 26 and the first section bottom member 28. A second locking plate 122 is attached to the second section 22, joining the second section top member 38 and the second section bottom member 40. The first locking plate has a hole 124 and the second locking plate has a hole 126, the holes 124, 126 aligning when the first and second sections 20,22 are closed. A padlock 128 can then be inserted into the holes 124,126.

To install the device 10, the user first attaches braces 70,72 to the utility pole 12, using the bolt 80 through brace holes 74,76 and utility pole hole 78. The second section 22 is then attached to braces 70,72 by utilizing fasteners 118 as described above. Prior to complete closure of the first section 20 to second section 22, the user inserts one or more panels 50 into the exposed ends of the desired upwardly and downwardly facing channel pair, that is for the first section's pair 60,66 or the second section's pair 62,68, as shown in FIG. 6. When the panel or panels 50 are properly situated, the first section 20 is closed with the second section 22, and additional fasteners 118 are utilized to attach the first section 20 to the braces 70,72, as described above. The closed first and second sections 20,22 can then be padlocked by inserting the lock 128 into the first locking plate hole 124 and the second locking plate hole 126.

When appropriately positioned on a utility pole 12, the headlights of an oncoming vehicle 16 on the highway 14 will strike the reflective material of the panel 50, thus fully illuminating the panel 50 and enabling the motorist to clearly view the message 52,54, traffic warning 56, or other visual effect. In the event a vehicle 16 lost control and struck the device 10, both the vehicle 16 and the utility pole 12 benefit from the energy absorbing characteristics of the resilient materials in the device 10.

It will be understood that each of the elements described above, or two or more together may also find a useful application in other applications differing from that described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for displaying a light reflective panel about a pole, the panel having a top edge and a bottom edge, comprising:

a housing, the housing having a first and second section, each section having a top housing member and a bottom housing member, each housing member having an inner edge, each inner edge being generally semicircular, the housing first and second sections further being pivotably connected and closable to form a generally circular aperture, the top and bottom housing members being sized such that the aperture circumvents the pole, and further, the housing first section and second section each having a downwardly facing and upwardly facing channel, the downwardly facing channels being sized to closely receive the panel top edge, the upwardly facing channels being sized to closely receive the panel bottom edge; and a mounting bracket for attaching the housing to the pole.

2. A device for attachment to poles, comprising:

a light reflective, elongated panel, the panel having a top edge and a bottom edge, a housing, the housing having a first and second section, each section having a top housing member and a bottom housing member, each housing member having an inner edge, each inner edge being generally semicircular, the housing first and second sections further being pivotably connected and closable to form a generally circular aperture, the top and bottom housing members being sized such that the aperture circumvents the pole, and further, the housing first section and second section each having a downwardly facing and upwardly facing channel, the downwardly facing channels being sized to closely receive the panel top edge, the upwardly facing channels being sized to closely receive the panel bottom edge; and a mounting bracket for attaching the housing to the pole.

3. The device of claim 2, wherein the housing first section has a first end, the first section first end having a hole, and the housing second section has a first end, the second section first end having a hole, the holes being substantially aligned and adjacent upon closure of the housing first and second sections.

4. The device of claim 3, further comprising a lock, the lock being attachable through the housing first section first end hole and the housing second section first end hole.

5. The device of claim 2, wherein, upon closure about the pole, the housing first section upwardly facing channel aligns with the housing second section upwardly facing channel, and further the housing first section downwardly facing channel aligns with the housing second section downwardly facing channel, such that the panel is positionable within the housing first and second sections simultaneously.

6. The device of claim 2, wherein the first and second housing sections are resilient.

7. The device of claim 2, wherein the first and second housing sections are made of at least some resilient materials.

8. The device of claim 2, wherein the housing first and second sections each have an outer edge, housing first section outer edge being generally parallel to the housing first section top and bottom member inner edges, the housing second section outer edge being generally parallel to the housing second section top and bottom member inner edges.

9. The device of claim 2, wherein the number of panels is two or more.

10. The device of claim 2, wherein:

the mounting bracket further comprises a pair of braces, each brace having an upper pair of threaded holes and a lower pair of threaded holes, each brace further having a fifth hole, the mounting bracket further comprising an elongated fastener for threading through the pole and through each of the brace fifth holes, for attaching the two braces with the pole between such braces;

the housing first section top member has a pair of holes and the housing second section top member has a pair of holes, the housing first and second section top member hole pairs aligning with the upper hole pairs on the two braces;

the housing first section bottom member has a pair of holes and the housing second section bottom member has a pair of holes, the housing first and second section bottom members' hole pairs aligning with the upper hole pairs on the two braces; and the device further comprises threaded fasteners for joining the housing first and second sections to the braces, by inserting the fasteners into the aligned hole pairs.

11. The device of claim 10, wherein the threaded fasteners are screws.

12. The device of claim 10, wherein the threaded fasteners are bolts.

13. The device of claim 10, wherein one of the upper threaded holes and one of the lower threaded holes on each brace are aligned with one of the top member holes and one of the bottom member holes, respectively, in the first section, and one of the upper threaded holes and one of the lower threaded holes on each brace are aligned with one of the top member holes and one of the bottom member holes, respectively, in the second section.

14. The device of claim 10, wherein the braces are X-shaped.

15. The device of claim 2, wherein the housing first and second sections each have at least one hole, and further wherein the mounting bracket further comprises at least two fasteners and at least one brace, the at least one brace being mounted to the pole, the at least one brace having a total of at least two holes, such at least two holes being alignable with the first and second housing sections'at least one hole, the alignments allowing fastening with the fasteners.

16. The device of claim 15, wherein the at least one brace extends between the housing top and bottom sections.

17. The device of claim 15, wherein the number of braces is two.

18. The device of claim 17, wherein the housing first and second sections each have a plurality of holes and the two braces each have a plurality of holes aligned with such first and second sections' plurality of holes, the alignments allowing fastening using the fasteners.

19. The device of claim 17, wherein the housing first and second sections each have a plurality of holes, the first brace has a plurality of holes aligned with at least one of the first section's holes and at least one of the second sections'holes, and the second brace has a plurality of holes aligned with at least one of the first section's holes and at least one of the second section's holes, the alignments allowing fastening using the fasteners.

20. The device of claim 17, wherein each brace has four holes, the housing first section has four holes and the housing second section has four holes, and further wherein two of the first brace holes align with two of the housing first section holes, two of the first brace holes align with two of the housing second section holes, two of the second brace holes align with two of the housing first section holes, and two of the second brace holes align with two of the housing second section holes, the alignments allowing fastening using the fasteners.

21. A device for attachment to poles, comprising:

a light reflective, elongated panel, the panel having a top edge and a bottom edge;

a housing, the housing having a first and second section, each section having a top housing member and a bottom housing member, each housing member having an inner edge, each inner edge being generally semicircular, the housing first and second sections further being pivotably connected and closable to form a generally circular aperture, the top and bottom housing members being sized such that the aperture circumvents the pole, and further, the housing first section and second section each having a downwardly facing and upwardly facing channel, the downwardly facing channels being sized to closely receive the panel top edge, the upwardly facing channels being sized to closely receive the panel bottom edge; and means for attaching the housing to the pole.

22. A device for attachment to poles, comprising:

a light reflective, elongated panel, the panel having a top edge and a bottom edge;

a housing, the housing having a first and second section, each section having a top housing member and a bottom housing member, each housing member being resilient and having an inner edge, each inner edge being generally semicircular, and an outer edge, the outer edge being generally parallel to the inner edge, the housing first and second sections further being pivotably connected and closable to form a generally circular aperture, the top and bottom housing members being sized such that the aperture circumvents the pole, and further, the housing first section and second section each having a downwardly facing and upwardly facing channel, the downwardly facing channels being sized to closely receive the panel top edge, the upwardly facing channels being sized to closely receive the panel bottom edge, the first and second section downwardly facing channels being aligned, and the upwardly facing channels being aligned, such that the panel is positionable within the housing first and second sections simultaneously, and a mounting bracket for attaching the housing to the pole.

23. The device of claim 22, wherein:

the mounting bracket further comprises a pair of braces, each brace having an upper pair of threaded holes and a lower pair of threaded holes, each brace further having a bolthole, the mounting bracket further comprising a bolt for threading through the pole and through the each of the brace boltholes, for attaching the two braces;

the housing first section top member has a pair of holes and the housing second section top member has a pair of holes, the housing top and bottom member hole pairs aligning with the upper hole pairs on the two braces;

the housing first section bottom member has a pair of holes and the housing second section bottom member has a pair of holes, the housing first and second section bottom members'hole pairs aligning with the upper hole pairs on the two braces; and the device further comprises threaded fasteners for joining the housing first and second sections to the braces, by inserting the fasteners into the aligned hole pairs.

* * * * *